US009476278B2

(12) United States Patent
Hradecky

(10) Patent No.: US 9,476,278 B2
(45) Date of Patent: Oct. 25, 2016

(54) ELECTRONICALLY ACTIVATED JARRING WITH TRAVELING RELEASE

(71) Applicant: Impact Selector, Inc., Heath, TX (US)

(72) Inventor: Jason Allen Hradecky, The Woodlands, TX (US)

(73) Assignee: Impact Selector International, LLC, Houma, LA (US)

( * ) Notice: Subject to any disclaimer, the term of this patent is extended or adjusted under 35 U.S.C. 154(b) by 485 days.

(21) Appl. No.: 14/079,836

(22) Filed: Nov. 14, 2013

(65) Prior Publication Data

US 2014/0131100 A1 May 15, 2014

Related U.S. Application Data

(60) Provisional application No. 61/726,312, filed on Nov. 14, 2012.

(51) Int. Cl.
*E21B 1/00* (2006.01)
*E21B 31/107* (2006.01)

(52) U.S. Cl.
CPC ..... *E21B 31/107* (2013.01)

(58) Field of Classification Search
CPC ..... E21B 31/107
See application file for complete search history.

(56) References Cited

U.S. PATENT DOCUMENTS

| | | | | |
|---|---|---|---|---|
| 4,376,468 | A * | 3/1983 | Clark | E21B 31/107 166/178 |
| 5,709,268 | A * | 1/1998 | Estilette, Sr. | E21B 31/107 166/178 |
| 7,111,678 | B2 * | 9/2006 | McElroy | E21B 31/107 166/178 |
| 8,256,509 | B2 * | 9/2012 | Evans | E21B 31/107 166/178 |
| 8,499,836 | B2 * | 8/2013 | Moriarty | E21B 31/107 166/178 |
| 8,561,688 | B2 * | 10/2013 | Evans | E21B 31/107 166/178 |
| 2009/0095490 | A1 * | 4/2009 | Moriarty | E21B 31/107 166/383 |

* cited by examiner

*Primary Examiner* — Nicole Coy
(74) *Attorney, Agent, or Firm* — Boisbrun Hofman, PLLC

(57) ABSTRACT

An impact apparatus conveyable in a tool string via conveyance means within a wellbore. The impact apparatus comprises a first portion, including a first interface coupled with a first tool string component, a first engagement feature, and a first impact feature. The impact apparatus also comprises a second portion, including a second interface coupled with a second tool string apparatus, a second engagement feature in selectable engagement with the first engagement feature, and a second impact feature positioned to impact the first impact feature in response to disengagement of the first and second engagement features and a tensile force applied across the tool string by the conveyance means. A release member positionable between first and second positions in response to a signal carried by the conveyance means prevents disengagement of the first and second engaging features when in the first position but not the second position.

18 Claims, 9 Drawing Sheets

ELECTRONICALLY ACTIVATED JARRING WITH TRAVELING RELEASE

CROSS-REFERENCE TO RELATED APPLICATIONS

This application claims priority to and the benefit of U.S. Provisional Application No. 61/726,312, entitled "ELECTRONICALLY ACTIVATED JAR WITH TRAVELING BLOCK RELEASE," filed Nov. 14, 2012, the entire disclosure of which is hereby incorporated herein by reference for all intents and purposes.

BACKGROUND OF THE DISCLOSURE

Drilling operations have become increasingly expensive in response to drilling in harsher environments through more difficult materials and/or deeper than previously possible. The cost and complexity of related downhole tools have, consequently, experienced similar increases. Furthermore, it thus follows that the risk associated with such operations and equipment has also grown. Accordingly, additional and more frequent precautionary steps are being utilized to insure or otherwise protect the related financial investments, as well as to mitigate the heightened risks.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
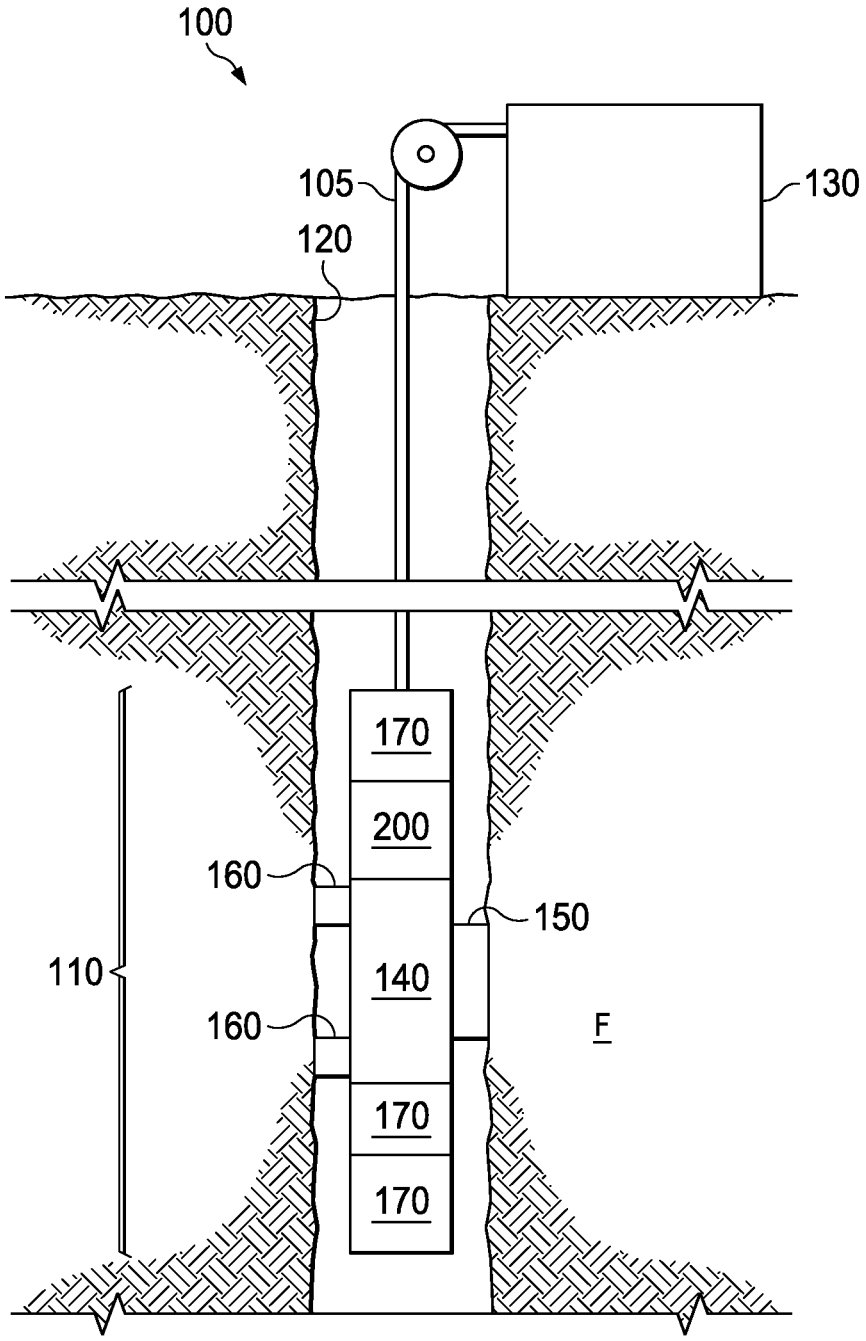
FIG. 1 is a sectional view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of an exemplary operating environment and/or system 100 within the scope of the present disclosure wherein a downhole tool 200 is suspended within a tool string 110 coupled to the end of a wireline, slickline, e-line, and/or other conveyance means 105 at a wellsite having a wellbore 120. The downhole tool 200, the tool string 110, and/or the conveyance means 105 may be structured, operated, and/or arranged with respect to a service vehicle and/or one or more other surface components at the wellsite, collectively referred to in FIG. 1 as surface equipment 130. The example system 100 may be utilized for various downhole operations including, without limitation, those for and/or related to completions, conveyance, drilling, formation evaluation, reservoir characterization, and/or production, among others.

For example, the tool string 110 may comprise a downhole tool 140 that may be utilized for testing a subterranean formation F and/or analyzing composition of one or more fluids within and/or obtained from the formation F. The downhole tool 140 may comprise an elongated body encasing and/or coupled to a variety of electronic components and/or modules that may be operable to provide predetermined functionality to the downhole tool 140. For example, the downhole tool 140 may comprise one or more static or selectively extendible apparatus 150 operable to interact with the sidewall of the wellbore 120 and/or the formation F, as well as one or more selectively extendible anchoring members 160 opposite the apparatus 150. The apparatus 150 may be operable to perform and/or be utilized for logging, testing, sampling, and/or other operations associated with the formation F, the wellbore 120, and/or fluids therein. For example, the apparatus 150 may be operable to selectively seal off or isolate one or more portions of the sidewall of the wellbore 120 such that pressure or fluid communication with the adjacent formation F may be established, such as where the apparatus 150 may be or comprise one or more probes, packers, probe modules, and/or packer modules.

The downhole tool 140 may be directly or indirectly coupled to the downhole tool 200 and/or other downhole tools 170 forming the tool string 110. Relative to the example implementation depicted in FIG. 1, the tool string 110 may comprise additional and/or alternative components within the scope of the present disclosure. The tool string 110, the surface equipment 130, and/or other portion(s) of the system 100 may also comprise associated telemetry/control devices/electronics and/or control/communication equipment.

Figure 2:
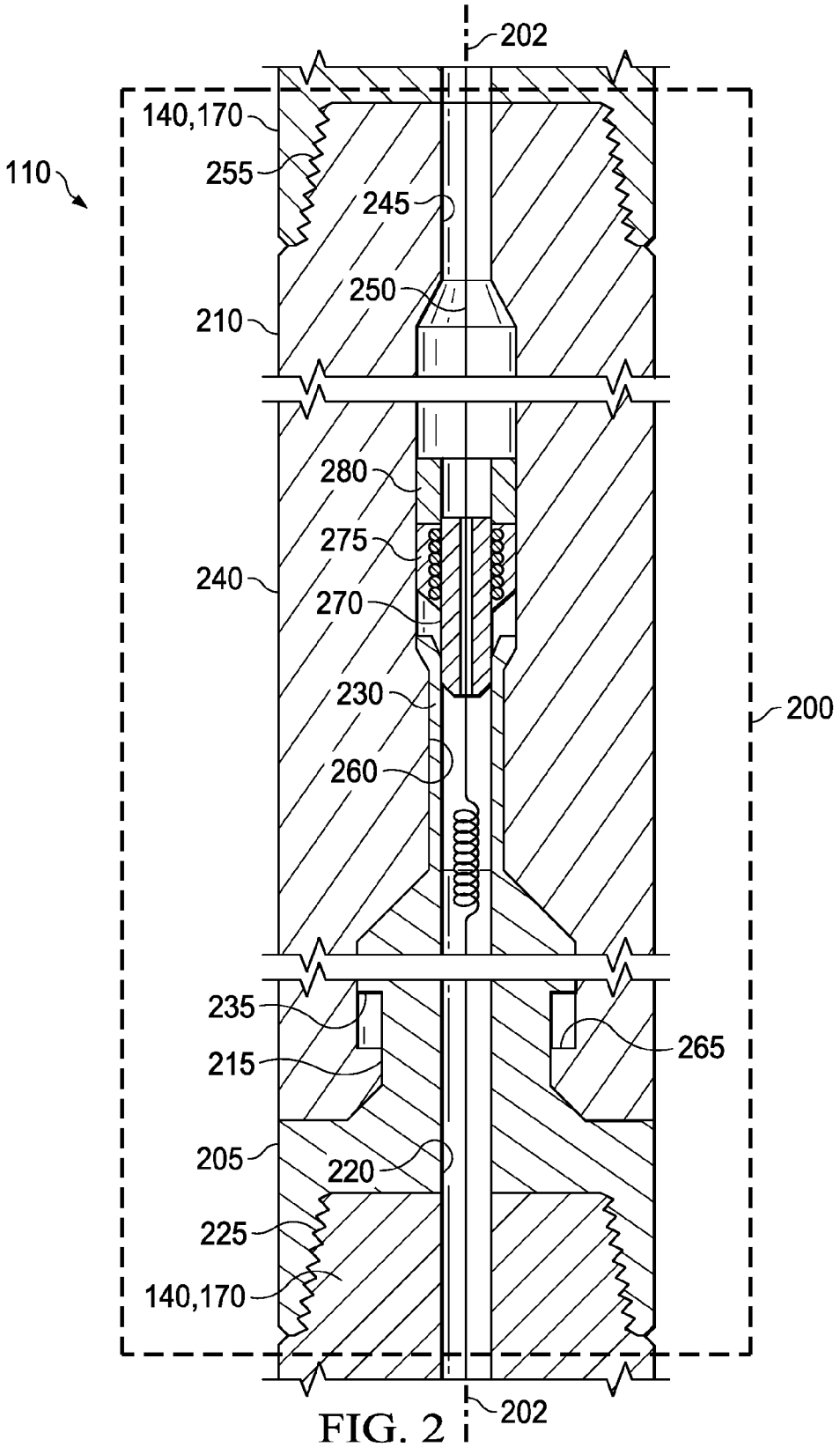
FIG. 2 is a sectional view of at least a portion of the apparatus shown in FIG. 1 according to one or more aspects of the present disclosure.
Figure 3:
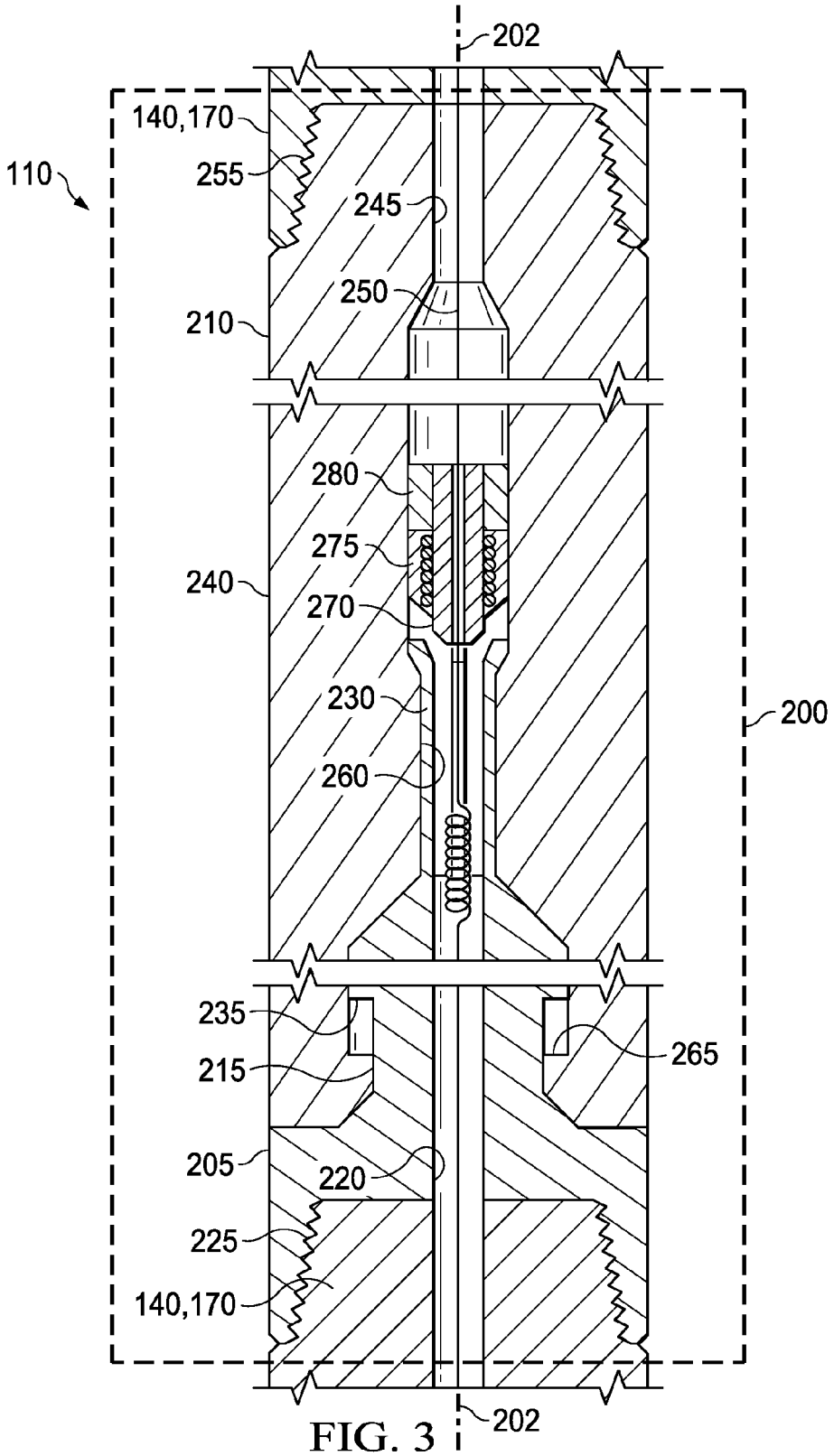
FIG. 3 is a sectional view of the apparatus shown in FIG. 2 in a subsequent stage of operation according to one or more aspects of the present disclosure.
Figure 4:
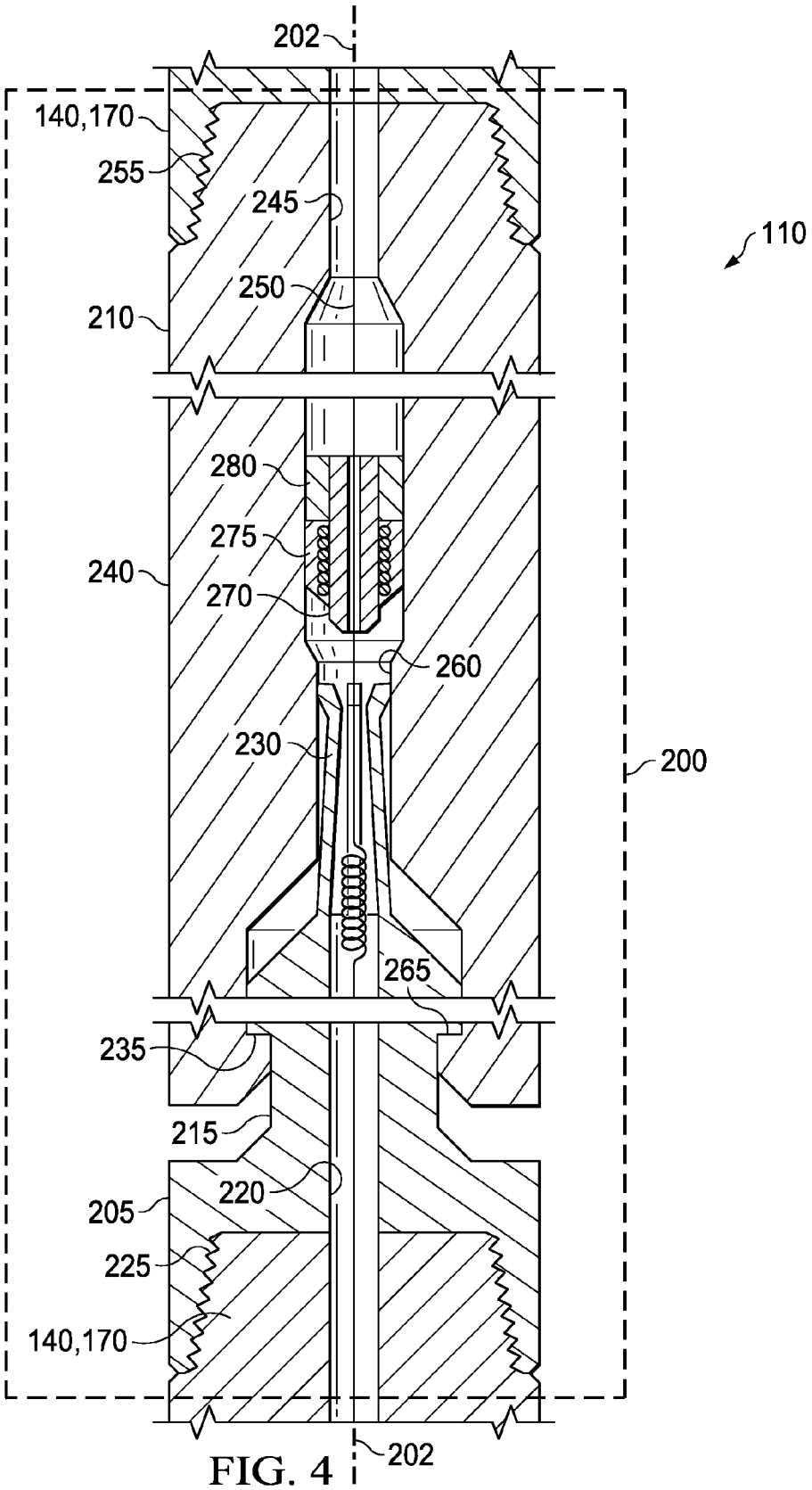
FIG. 4 is a sectional view of the apparatus shown in FIG. 3 in a subsequent stage of operation according to one or more aspects of the present disclosure.
Figure 5:
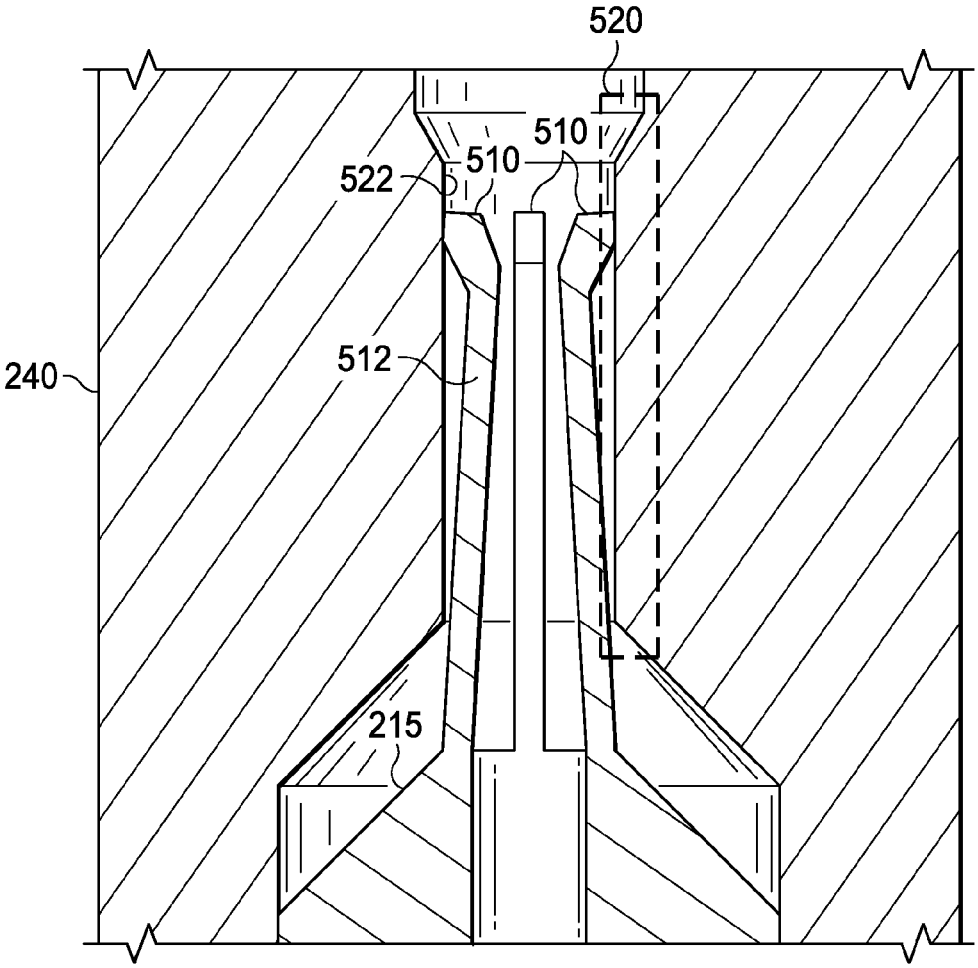
FIG. 5 is a sectional view of a portion of the apparatus shown in FIG. 1 according to one or more aspects of the present disclosure.
Figure 6:
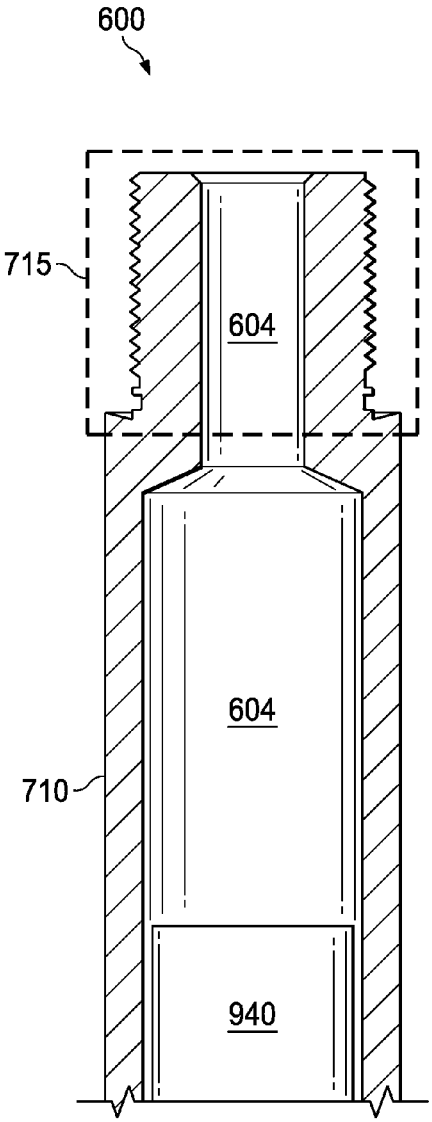
FIG. 6 is a sectional view of a portion of the apparatus shown in FIG. 1 according to one or more aspects of the present disclosure.

The downhole tool 200 is or comprises an impact apparatus operable to impart an impart force to at least a portion of the tool string 110 in the event the tool string 110 becomes lodged in the wellbore 120. FIG. 2 is a sectional view of different axial portions of the downhole tool 200, as well as other portions of the tool string 110. Similarly, FIGS. 3 and 4 are sectional views of the downhole tool 200 but in different stages of operation. FIG. 5 is an enlarged view of a portion of FIG. 4. The following description refers to FIGS. 2-5, collectively, unless otherwise specified.

The downhole tool 200 comprises a first portion 205 and a second portion 210 that are slidably engaged with one another. A body 215 of the first portion 205 may substantially comprise one or more metallic and/or other substantially rigid members collectively having a central passage 220. The body 215 may have a shape resembling a pipe, tube, or conduit, such as may be substantially cylindrical and/or substantially annular.

An end of the body 215 may comprise an interface 225 for coupling with another component of the tool string 110, such as one of the downhole tools 140 and/or 170 shown in FIG. 1. The interface 225 may threadedly couple with the other component of the tool string 110, although other types of couplings are also within the scope of the present disclosure. The end of the body 215 comprising the interface 225 may be flanged or otherwise be greater in cross-sectional diameter relative to the remainder of the body 215.

The other end of the body 215 carries a first engagement feature 230. The first engagement feature 230 may be formed integral to the body 215, or may be a discrete component or subassembly coupled to the body 215 by threaded fastening means, interference fit, and/or other coupling means.

The first portion 205 of the downhole tool 200 also comprises an impact feature 235. For example, in the example implementation depicted in FIG. 2, the impact feature 235 is a shoulder that is integral to the body 215 and substantially perpendicular to the longitudinal axis 202 of the downhole tool. However, a discrete member coupled to the body 215 by threaded fastening means, interference fit, and/or other coupling means may also or alternatively form the shoulder and/or other type of impact feature 235.

A body 240 of the second portion 210 may substantially comprise one or more metallic and/or other substantially rigid members. The body 240 may have a central passage 245 that is substantially coaxial and/or otherwise aligned and/or in physical communication with the central passage(s) 220 of the first portion 205. As such, one or more wires and/or other conductors 250 may extend through the first portion 205, the second portion 210, and components thereof, such that an electrical signal transmitted from surface to the tool string may pass through the downhole tool 200 to lower components of the tool string. The body 240 may have a shape resembling a pipe, tube, or conduit, such as may be substantially cylindrical and/or substantially annular.

An end of the body 240 may comprise an interface 255 for coupling with another component of the tool string 110, such as one of the downhole tools 140 and/or 170 shown in FIG. 1. The interface 255 may threadedly couple with the other component of the tool string 110, although other types of couplings are also within the scope of the present disclosure.

The body 240 carries a second engagement feature 260, which may be integral to the body 240 or a discrete component or subassembly coupled to the body 240 by threaded fastening means, interference fit, and/or other coupling means. The second engagement feature 260 is depicted in FIG. 2 as being engaged with the first engagement feature 230. Such engagement is selectable, as described below.

The second portion 210 of the downhole tool 200 also comprises an impact feature 265. For example, in the example implementation depicted in FIG. 2, the impact feature 265 is a shoulder that is integral to the body 240 and substantially perpendicular to the longitudinal axis 202 of the downhole tool. However, a discrete member coupled to the body 240 by threaded fastening means, interference fit, and/or other coupling means may also or alternatively form the shoulder and/or other type of impact feature 265.

The body 240 also carries a release member 270. The release member 270 is repositionable between a first position, shown in FIG. 2, and a second position, shown in FIGS. 3 and 4. Such repositioning is in response to an electronic signal carried by the conveyance means 105 (FIG. 1). For example, the first electronic signal transmitted from surface to the downhole tool 200 via the conveyance means 105 may initiate the repositioning of the release member 270 from the first position towards or to the second position, and a second electronic signal transmitted from surface to the downhole tool 200 via the conveyance means 105 may initiate the repositioning of the release member 270 from the second position towards or to the first position.

As mentioned above, the engagement of the first and second engagement features 230 and 260 may be selective, selectable, or otherwise adjustable. That is, the release member 270 prevents disengagement of the first and second engagement features 230 and 260 when in the first position (FIG. 2), but not when in the second position (FIGS. 3 and 4). By selectively transmitting predetermined signals to the downhole tool 200 via the conveyance means 105, the release member 270 may be repositioned between the first and second positions, thus selectively permitting or preventing the disengagement of the first and second engaging features 230 and 260.

As best shown in FIG. 5, the first engagement feature 230 may comprise a plurality of longitudinal, cantilevered fingers and/or other flexible members 510, such as may form a collet and/or other type of latching mechanism. The second engagement feature 260 may comprise or be an inward-protruding portion 520 of the body 240. Each flexible member 510 may have an exterior profile 512 that corresponds to an interior profile 522 of the inward-protruding portion 520. Thus, as shown in FIGS. 2 and 3, the exterior profile 512 of each flexible member 510 may be mated with or otherwise be in engagement with the interior profile 522 of the inward-protruding portion 520 of the body 240. Thus, FIGS. 2 and 3 depict an example implementation in which the first and second engagement features 230 and 260 are engaged, and FIGS. 4 and 5 depict the example implementation in which the first and second engagement features 230 and 260 are disengaged.

Returning to FIG. 2, when the first and second engagement features 230 and 260 are engaged, and the release member 270 is in the first position, an end of the release member 270 interposes ends of the flexible members 510 of the first engagement feature 230, such that contact between an outer surface of the release member 270 and an inner surface of the flexible members 510 prevents disengagement of the first engagement feature 230 from the second engagement feature 260. That is, the positioning of the release member 270 within the first engagement feature 230 prevents the inward deflection of the ends of the flexible members 510, thus preventing the axial separation of the first and second portions 205 and 210 of the downhole tool 200.

However, as shown in FIG. 3, when the release member 270 is repositioned to the second position, such that the release member 270 no longer protrudes into the first engagement feature 230, the release member 270 does not prevent disengagement of the first and second engagement features 230 and 260. Accordingly, a tensile force acting on the second portion 210 of the downhole tool 200, such as in response to a pull load applied to the downhole tool 200 and/or other portion of the tool string via the conveyance means 105, will disengage the first and second engagement features 230 and 260. Consequently, the first and second portions 205 and 210 of the downhole tool 200 will axially separate, as shown in FIG. 4.

Depending on the tensile force acting on the second portion 210 of the downhole tool 200, the axial separation of the first and second portions 205 and 210 may be quite rapid. However, the first and second impact features 235 and 265 will limit the axial separation when they impact one another. The force of the impact, which depends on the tensile force acting across the downhole tool 200, is then imparted to a remaining portion of the tool string, via the interface 225 and similar interfaces between components of the tool string below (i.e., deeper in the wellbore) the downhole tool 200.

The imparted impact force may be utilized to aid in dislodging a portion of the tool string that has become stuck in the wellbore. However, if the impact force fails to dislodge the stuck portion of the tool string, the downhole tool 200 may be reset. That is, the pull load applied to the downhole tool 200 and/or other portion of the tool string via the conveyance means 105 may be decreased, thus allowing the axial separation of the first and second portions 205 and 210 to decrease. The relative axial translation of the first and second engagement features 230 and 260 also axially displaces the release member 270 relative to the second portion 210. After a sufficient decrease of the axial separation of the first and second portions 205 and 210, the first and second engagement features 230 and 260 may reengage. Such reengagement decreases or eliminates the inward deflection of the ends of the flexible members 510 of the first engagement feature 230, thus permitting the release member 270 to once again be repositioned to the first position, as shown in FIG. 2. Such repositioning to the first position may be in response to an electronic signal transmitted via the conveyance means. Alternatively, or additionally, one or more springs and/or other mechanical and/or electrical biasing features may be utilized in the repositioning of the release member 270 to the first position.

As described above, the release member 270 may be translated between the first and second positions in response to the downhole tool 200 receiving an electronic signal sent from surface via the conveyance means 105. The second portion 210 of the downhole tool 200 may comprise or otherwise carry an actuator 275 operable to reposition the release member 270 between the first and second positions in response to the signal. In the example implementation shown in FIGS. 2-4, the actuator 275 is depicted as an electronic solenoid switch. However, the actuator 275 may alternatively or additionally comprise other electronic, magnetic, and/or electromagnetic devices.

The electronic signal may be transmitted from surface via the conveyance means 105 and the conductor 250 (and perhaps other intervening components of the tool string) to a receiver of the actuator 275 and/or other electronics 280 of the downhole tool 200. If such signal is transmitted to the downhole tool 200 for the purpose of triggering the downhole tool 200 to perform an impact, the downhole tool 200 may already be under tension as a result of a pull load being maintained at a predetermined threshold on the conveyance means 105 at surface. In such scenario, the signal received by the receiver of the actuator 275 and/or other electronics 280 of the downhole tool 200 may be to cause the actuator 275 and/or other component of the downhole tool 200 to axially translate the release member 270 towards or to the second position shown in FIG. 3, which in turn allows the rapid axial separation of the first and second portions 205 and 210 of the downhole tool to cause an impact, as shown in FIG. 4. Thereafter, the pull load may be decreased, allowing the reengagement of the first and second engagement features 230 and 260. A subsequent signal may then be transmitted to the downhole tool 200 to cause the actuator 275 and/or other component of the downhole tool 200 to axially translate the release member 270 towards or to the first position, shown in FIG. 2. This cycle may be repeated as necessary to dislodge the stuck portion of the tool string.

In some implementations, successive cycles may utilize a higher predetermined tension maintained by the pull load on the conveyance means 105 at surface, relative to previous cycles. For example, each successive cycle may utilize a predetermined tension that is about 10% higher than the immediately preceding cycle. However, other intervals are also within the scope of the present application, and multiple cycles may be performed at each predetermined tension level.

FIGS. 6-11 are sectional views of various axial portions of another example implementation of the downhole tool 200 shown in FIGS. 1-5, herein designated by reference numeral 600. The following description refers to FIGS. 1 and 6-11, collectively, unless otherwise specified.

As with the example implementation shown in FIGS. 2-5, the downhole tool 600 is or comprises an impact apparatus operable to impart an impart force to at least a portion of the tool string 110 in the event the tool string 110 becomes lodged in the wellbore 120. The downhole tool 600 comprises a first portion and a second portion that are slidably engaged with one another. From top to bottom, the first portion of the downhole tool 600 includes an upper housing 710 (spanning FIGS. 6 and 7), a housing connector 720 (FIG. 7) coupled to the upper housing 710, an intermediate housing 730 (spanning FIGS. 7 and 8) coupled to the a housing connector 720, a lower housing 740 (spanning FIGS. 8-10) coupled to the intermediate housing 730, and a terminating housing 750 (spanning FIGS. 9 and 10) coupled to the lower housing 740. The second portion of the downhole tool 600 includes, from top to bottom, a first engagement feature 810 (FIG. 7), a shaft 820 (spanning FIGS. 7-9) coupled to the first engagement feature 810, a mandrel 830 (spanning FIGS. 9 and 10) coupled to the shaft 820, and a lower joint connection 840 (spanning FIGS. 10 and 11) coupled to the mandrel 830.

The upper housing 710 may comprise an interface 715 for coupling with another component of the tool string 110, such as one of the downhole tools 140 and/or 170 shown in FIG. 1. The interface 715 may threadedly couple with the other component of the tool string 110, although other types of couplings are also within the scope of the present disclosure.

The lower joint connection 840 may comprise an interface 845 for coupling with another component of the tool string 110, such as one of the downhole tools 140 and/or 170 shown in FIG. 1. The interface 845 may threadedly couple with the other component of the tool string 110, although other types of couplings are also within the scope of the present disclosure.

Figure 7:
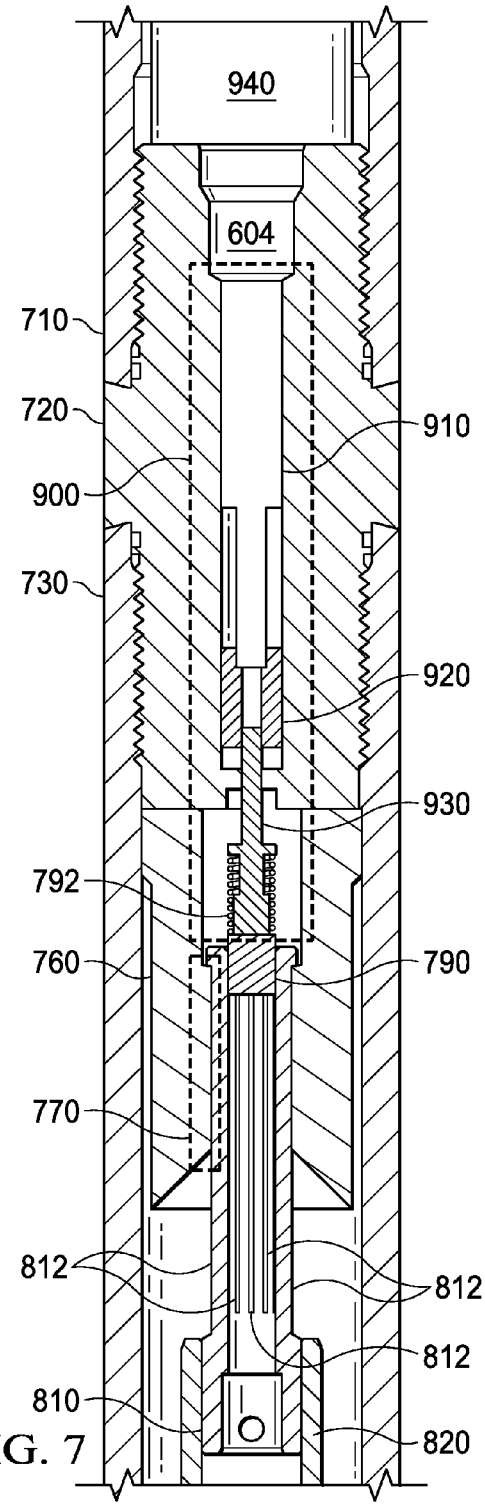
FIG. 7 is a sectional view of another portion of the apparatus shown in FIG. 6 according to one or more aspects of the present disclosure.
Figure 8:
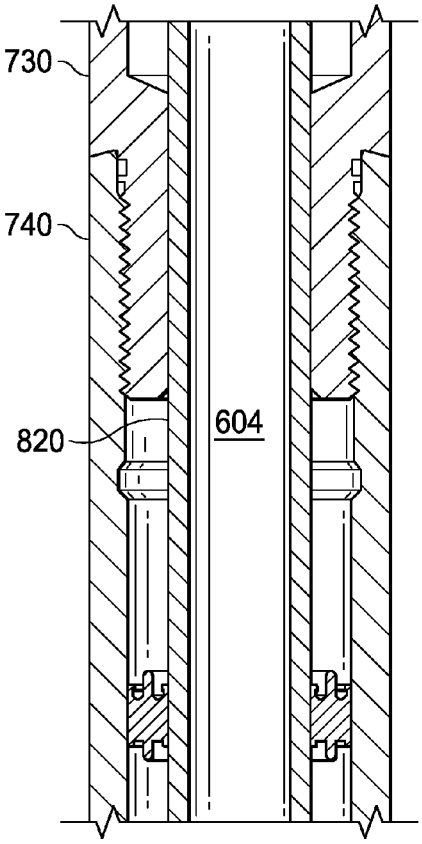
FIG. 8 is a sectional view of another portion of the apparatus shown in FIGS. 6 and 7 according to one or more aspects of the present disclosure.
Figure 9:
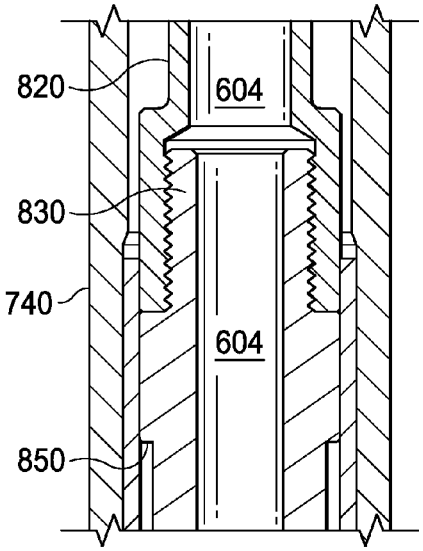
FIG. 9 is a sectional view of another portion of the apparatus shown in FIGS. 6-8 according to one or more aspects of the present disclosure.
Figure 10:
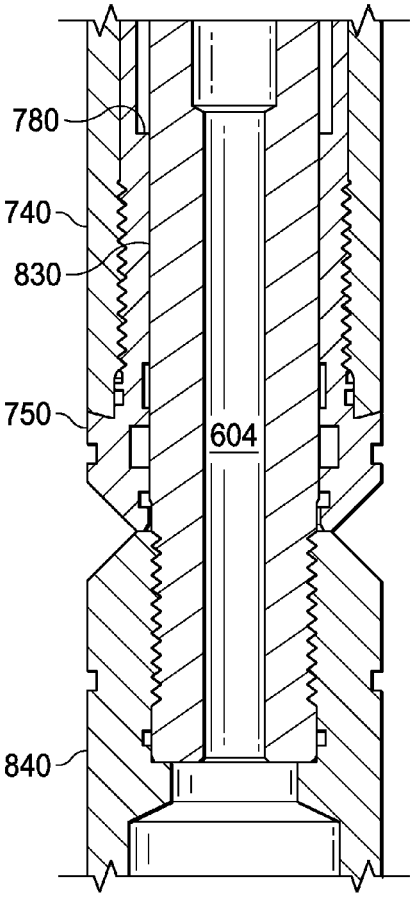
FIG. 10 is a sectional view of another portion of the apparatus shown in FIGS. 6-9 according to one or more aspects of the present disclosure.
Figure 11:
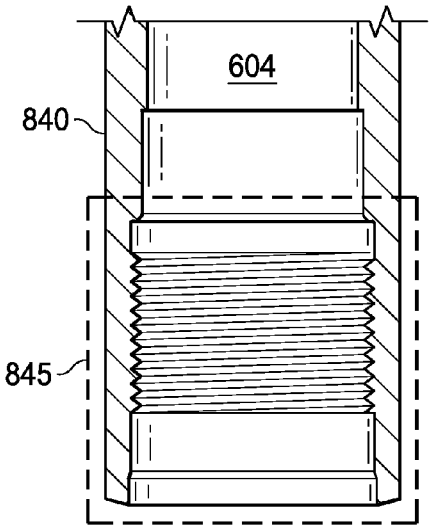
FIG. 11 is a sectional view of another portion of the apparatus shown in FIGS. 6-10 according to one or more aspects of the present disclosure.

A mandrel 760 (FIG. 7) carried by the housing connector 720 and/or the intermediate housing 730 may carry a second engagement feature 770. The second engagement feature 770 may be substantially similar to the second engagement feature 260 as described above and/or as shown in FIGS. 2-5, except perhaps as described below and/or as shown in FIG. 7. The second engagement feature 770 may comprise or be an inwardly protruding portion of the mandrel 760, and may thus form a portion of the inner profile of the mandrel 760.

The first engagement feature 810 may be integral to the shaft 820, or may be a discrete component or subassembly coupled to the shaft 820 by threaded fastening means, interference fit, and/or other coupling means. The first engagement feature 810 is depicted in FIG. 7 as being engaged with the second engagement feature 770. As with the example implementations described above, such engagement is selectable, selective, or otherwise adjustable.

The first portion of the downhole tool 600 also comprises an impact feature 780. For example, in the example implementation depicted in FIG. 10, the impact feature 780 is a shoulder that is integral to the terminating housing 750 and substantially perpendicular to the longitudinal axis 602 of the downhole tool. However, a discrete member coupled to the terminating housing 750 and/or another component of the first portion of the downhole tool 600, whether by threaded fastening means, interference fit, and/or other coupling means, may also or alternatively form the shoulder and/or other type of impact feature 780.

The second portion 210 of the downhole tool 200 also comprises an impact feature 850. For example, in the example implementation depicted in FIG. 9, the impact feature 850 is a shoulder that is integral to the mandrel 830 and substantially perpendicular to the longitudinal axis 602 of the downhole tool 600. However, a discrete member coupled to the mandrel 830 and/or another component of the second portion of the downhole tool 600, whether by threaded fastening means, interference fit, and/or other coupling means, may also or alternatively form the shoulder and/or other type of impact feature 850.

The mandrel 760 also carries a release member 790. The release member 790 is repositionable between a first position (shown in FIG. 7) and a second position (not shown). Such repositioning is in response to an electronic signal carried by the conveyance means 105 (FIG. 1). For example, the first electronic signal transmitted from surface to the downhole tool 600 via the conveyance means 105 may initiate the repositioning of the release member 790 from the first position towards or to the second position, and a second electronic signal transmitted from surface to the downhole tool 600 via the conveyance means 105 may initiate the repositioning of the release member 790 from the second position towards or to the first position. Transmission of such signals may include conduction along one or more conductive members similar to the conductive member(s) 250 described above. Such conductive members are omitted from the depictions in FIGS. 6-11, although merely for the sake of simplicity, as a person having ordinary skill in the art will readily understand that implementations of the downhole tool 600 within the scope of the present disclosure include such conductive members extending through the downhole tool 600. Similarly, the downhole tool 600 includes various central or otherwise internal passages 604 through which such conductive members extend, even though some of these passages may not be shown in FIGS. 6-11.

As mentioned above, the engagement of the first and second engagement features 810 and 770 may be selective, selectable, or otherwise adjustable. That is, the release member 790 prevents disengagement of the first and second engaging features 810 and 770 when in the first position, but not when in the second position. By selectively transmitting predetermined signals to the downhole tool 600 via the conveyance means 105, the release member 790 may be repositioned between the first and second positions, thus selectively permitting or preventing the disengagement of the first and second engaging features 810 and 770.

As shown in FIG. 7, the first engagement feature 810 may comprise a plurality of longitudinal, cantilevered fingers and/or other flexible members 812, such as may form a collet and/or other type of latching mechanism. Each flexible member 812 may have an exterior profile that corresponds to an interior profile of the inward-protruding portion 770. Thus, the exterior profile of each flexible member 812 may be mated with or otherwise be in engagement with the interior profile of the inward-protruding portion 770 of the mandrel 760. The first and second engagement features 810 and 770, and/or one or more aspects of their engagement, may be substantially similar or identical to those described above, with the possible exceptions being differences noted in the figures.

When the first and second engagement features 810 and 770 are engaged, and the release member 790 is in the first position, an end of the release member 790 interposes ends of the flexible members 812 of the first engagement feature 810, such that contact between an outer surface of the release member 790 and an inner surface of the flexible members 812 prevents disengagement of the first engagement feature 810 from the second engagement feature 770. That is, the positioning of the release member 790 within the end of the first engagement feature 810 prevents the inward deflection of the ends of the flexible members 812, thus preventing the axial separation of the first and second portions of the downhole tool 600.

However, when the release member 790 is repositioned to the second position, such that the release member 790 no longer protrudes into the end of the first engagement feature 810, the release member 790 does not prevent disengagement of the first and second engagement features 810 and 770. Accordingly, a tensile force acting on the second portion of the downhole tool 600, such as in response to a pull load applied to the downhole tool 600 and/or other portion of the tool string via the conveyance means 105, will disengage the first and second engagement features 810 and 770. Consequently, the first and second portions of the downhole tool 600 will axially separate.

Depending on the tensile force acting on the second portion of the downhole tool 600, the axial separation of the first and second portions may be quite rapid. However, the impact features 780 and 850 will limit the axial separation when they impact one another. The force of the impact, which depends on the tensile force acting across the downhole tool 600, is then imparted to a remaining portion of the tool string, via the interface 845 and similar interfaces between components of the tool string below (i.e., deeper in the wellbore) the downhole tool 600.

The imparted impact force may be utilized to aid in dislodging a portion of the tool string that has become stuck in the wellbore. However, if the impact force fails to dislodge the stuck portion of the tool string, the downhole tool 600 may be reset. That is, the pull load applied to the downhole tool 600 and/or other portion of the tool string via the conveyance means 105 may be decreased, thus allowing the axial separation of the first and second portions of the downhole tool 600 to decrease. The relative axial translation of the first and second engagement features 810 and 770 also axially displaces the release member 790 relative to the second portion of the downhole tool 600. After a sufficient decrease of the axial separation of the first and second portions of the downhole tool 600, the first and second engagement features 810 and 770 may reengage. Such reengagement decreases or eliminates the inward deflection of the ends of the flexible members 812 of the first engagement feature 810, thus permitting the release member 790 to once again be repositioned to the first position, as shown in FIG. 7. Such repositioning to the first position may be in response to an electronic signal transmitted via the conveyance means 105. Alternatively, or additionally, one or more springs and/or other mechanical and/or electrical biasing features 792 may be utilized in the repositioning of the release member 790 to the first position.

As described above, the release member 790 may be translated between the first and second positions in response to the downhole tool 600 receiving an electronic signal sent from surface via the conveyance means 105. The second portion of the downhole tool 600 may comprise or otherwise carry an actuator 900 operable to reposition the release member 790 between the first and second positions in response to the signal. In the example implementation shown in FIG. 7, the actuator 900 comprises an electric motor 910 operable to rotate a rotary member 920. The rotary member 920 is threadedly coupled to a rod 930, which is keyed to the housing connector 720 and/or otherwise prevented from rotating but permitted to axially translate. The rod 930 is coupled to the release member 790. Rotation of the electric motor 910 is imparted to the rotary member 920. Rotation of the rotary member 920 imparts axial movement of the rod 730, due to the threaded coupling thereof. The axial movement of the rod 730 is imparted to the release member 790. Thus, by selectively controlling the electric motor 910, the release member 790 may be translated axially between the first and second positions. After an impact cycle, the electric motor 910 may be operated in the reverse direction to reinsert the release member 790 into the end of the first engagement feature 810.

The electronic signal may be transmitted from surface via the conveyance means 105 (and perhaps other intervening components of the tool string) to a receiver associated with the actuator 900 and/or other electronics 940 of the downhole tool 600. If such signal is transmitted to the downhole tool 600 for the purpose of triggering the downhole tool 600 to perform an impact, the downhole tool 600 may already be under tension as a result of a pull load being maintained at a predetermined threshold on the conveyance means 105 at surface. In such scenario, the signal received by the receiver of the actuator 900 and/or other electronics 940 of the downhole tool 600 may be to cause the actuator 900 and/or other component of the downhole tool 600 to axially translate the release member 790 towards or to the second position, which in turn allows the rapid axial separation of the first and second portions of the downhole tool 600 to cause the desired impact. Thereafter, the pull load may be decreased, allowing the reengagement of the first and second engagement features 810 and 770. A subsequent signal may then be transmitted to the downhole tool 600 to cause the actuator 900 and/or other component of the downhole tool 600 to axially translate the release member 790 towards or to the first position, as shown in FIG. 7. This cycle may be repeated as necessary to dislodge the stuck portion of the tool string.

In some implementations, successive cycles may utilize a higher predetermined tension maintained by the pull load on the conveyance means 105 at surface. For example, successive cycles may utilize a predetermined tension that is about 5-10% higher than a preceding cycle. However, other intervals are also within the scope of the present application, and multiple cycles may be performed at individual predetermined tension levels.

Figure 12:
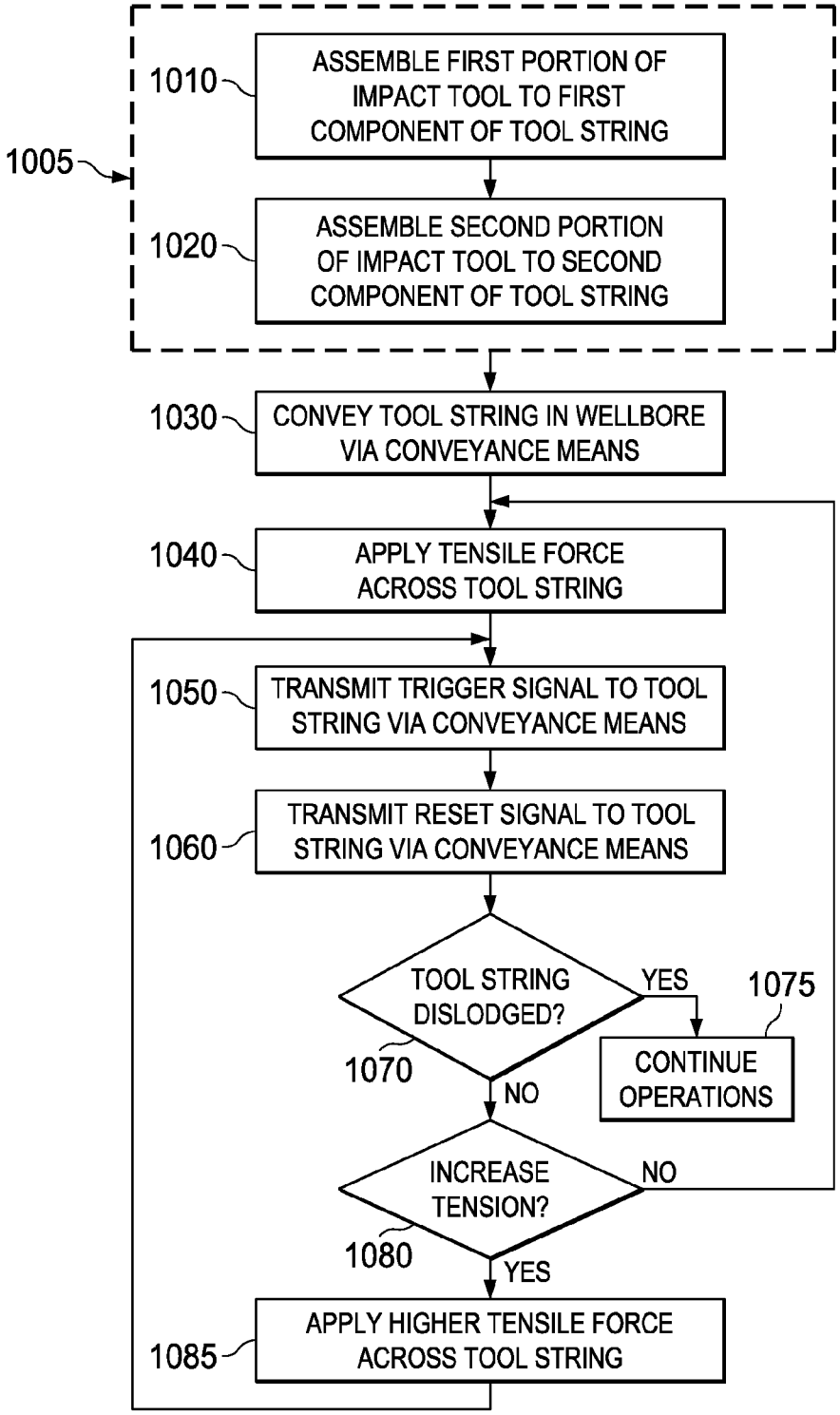
FIG. 12 is a flow-chart diagram of at least a portion of a method according to one or more aspects of the present disclosure.

FIG. 12 is a flow-chart diagram of at least a portion of a method (1000) according to one or more aspects of the present disclosure. The method (1000) is one example of many within the scope of the present disclosure which may be executed at least in part within the environment depicted in FIG. 1 and/or utilizing apparatus having one or more aspects in common with the downhole tool 200 shown in FIGS. 2-5 and/or the downhole tool 600 shown in FIGS. 6-11.

The method (1000) initially comprises assembling (1005) a tool string conveyable via conveyance means within a wellbore penetrating a subterranean formation. Assembling the tool string may comprise assembling (1010) a first portion of an impact apparatus to a first component of the tool string and assembling (1020) a second portion of the impact apparatus to a second component of the tool string. The first and second portions of the impact apparatus may be substantially similar or identical to the example implementations described above and/or otherwise within the scope of the present disclosure. For example, the first portion may comprise a first engagement feature and a first impact feature, and the second portion may comprise: (1) a second engagement feature in selectable engagement with the first engagement feature; (2) a second impact feature positioned to impact the first impact feature in response to disengagement of the first and second engagement features and a tensile force applied to one of the first and second tool string components by the conveyance means; and (3) a release member positionable between first and second positions in response to a signal carried by the conveyance means, wherein the release member prevents disengagement of the first and second engaging features when in the first position but not the second position.

The method (1000) may further comprise conveying (1030) the tool string via the conveyance means within the wellbore. Should the tool string or a component thereof become lodged in the wellbore, the method (1000) may further comprise applying (1040) the tensile force to one of the first and second tool string components and/or otherwise across the impact apparatus and/or tool string. Thereafter, the signal is transmitted (1050) to the tool string via the conveyance means. Applying the tensile force may comprise increasing a pull load on the conveyance means to a predetermined threshold (i.e., from a smaller load) and maintaining the pull load at the predetermined threshold while the signal is transmitted to the tool string, such that the release member is repositioned from the first position to the second position, the first and second engagement members disengage, and the first and second impact features impact.

The method (1000) may further comprise reducing the pull load a sufficient amount for the first and second engagement members to reengage, and then transmitting (1060) a reset signal and/or otherwise adjusting the signal transmitted to the tool string. Such reset/adjustment may cause the repositioning of the release member from the second position to the first position.

If the tool string is determined (1070) to have been dislodged, then normal operations may be continued (1075). If the tool string is determined (1070) to have not been dislodged, then the method (1000) may include the option (1080) of increasing the predetermined tension at which the next impact is to be triggered. If no increase is desired, the original tensile force may again be applied (1040), and the trigger signal may again be transmitted (1050) to the tool string. If an increase is desired, the increased tensile force may be applied (1085), and the trigger signal may again be transmitted (1050). Either cycle may be continued until it is determined (1070) that the tool string has been dislodged.

In view of the entirety of the present disclosure, including the appended figures and the claims set forth below, a person having ordinary skill in the art should readily recognize that the present disclosure introduces an apparatus comprising an impact apparatus conveyable in a tool string via conveyance means within a wellbore extending into a subterranean formation. The impact apparatus comprises a first portion and a second portion. The first portion comprises a first interface for coupling with a first downhole apparatus, a first engagement feature, and a first impact feature. The second portion comprises: a second interface for coupling with a second downhole apparatus; a second engagement feature in selectable engagement with the first engagement feature; a second impact feature positioned to impact the first impact feature in response to disengagement of the first and second engagement features and a tensile force applied to one of the first and second downhole apparatus by the conveyance means; and a release member positionable between first and second positions in response to a signal carried by the conveyance means, wherein the release member prevents disengagement of the first and second engaging features when in the first position but not the second position.

The first and second interfaces may be for threadedly coupling with the first and second downhole apparatus, respectively.

The selectable engagement of the first and second engagement features may comprise engagement of an outer surface of the first engagement feature and an inner surface of the second engagement feature. An outer surface of the release member may contact an inner surface of the first engagement feature when the release member is in the first position. The outer surface of the release member may not contact the inner surface of the first engagement feature when the release member is in the second position.

The first engagement feature may comprise a plurality of flexible members each having a first profile, and the second engagement member may comprise a substantially annular member having an inner surface, wherein the inner surface may have a second profile substantially corresponding to the first profile. The release member may contact an inner surface of at least one of the plurality of flexible members when in the first position. The release member may not contact the inner surface of any of the plurality of flexible members when in the second position.

The second portion may further comprise an actuator operable to reposition the release member between the first and second positions in response to the signal. The actuator may comprise an electronic solenoid switch.

The second portion may further comprise: an actuator operable to reposition the release member from the first position to the second position; and a mechanical, electrical, electromechanical, magnetic, or electromagnetic biasing member operable to reposition the release member from the second position to the first position.

The first and second impact features may comprise substantially parallel features carried by the first and second portions, respectively. The substantially parallel features may be substantially perpendicular to a longitudinal axis of the impact apparatus.

The impact apparatus may further comprise an electrical conductor extending through passages of each of the first and second interfaces, the first and second engagement features, and the release member.

The apparatus may further comprise the first and second downhole apparatus.

The present disclosure also introduces a method comprising assembling a tool string conveyable via conveyance means within a wellbore penetrating a subterranean formation, wherein assembling the tool string comprises: assembling a first portion of an impact apparatus to a first component of the tool string, wherein the first portion comprises: a first engagement feature; and a first impact feature; and assembling a second portion of the impact apparatus to a second component of the tool string, wherein the second portion comprises: a second engagement feature in selectable engagement with the first engagement feature; a second impact feature positioned to impact the first impact feature in response to disengagement of the first and second engagement features and a tensile force applied to one of the first and second tool string components by the conveyance means; and a release member positionable between first and second positions in response to a signal carried by the conveyance means, wherein the release member prevents disengagement of the first and second engaging features when in the first position but not the second position.

The method may further comprise: conveying the tool string via the conveyance means within the wellbore; applying the tensile force to one of the first and second tool string components; and transmitting the signal to the tool string via the conveyance means. Applying the tensile force may comprises: increasing a pull load on the conveyance means to a predetermined threshold, from a smaller load; and maintaining the pull load at the predetermined threshold while the signal is transmitted to the tool string and the release member is subsequently repositioned from the first position to the second position, wherein the first and second engagement members disengage and the first and second impact features impact. The method may further comprise: reducing the pull load a sufficient amount for the first and second engagement members to reengage; and adjusting the signal transmitted to the tool string to reposition the release member from the second position to the first position. The predetermined threshold may be a first predetermined threshold, and the method may further comprise: after the first and second engagement members are again engaged, increasing the pull load on the conveyance means to a second predetermined threshold that is substantially greater than the first predetermined threshold; and maintaining the pull load at the second predetermined threshold while the signal is again transmitted to the tool string and the release member is again repositioned from the first position to the second position.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

an impact apparatus conveyable in a tool string via conveyance means within a wellbore extending into a subterranean formation, wherein the impact apparatus comprises:

a first portion, comprising:

a first interface for coupling with a first downhole apparatus;

a first engagement feature; and a first impact feature; and a second portion, comprising:

a second interface for coupling with a second downhole apparatus;

a second engagement feature in selectable engagement with the first engagement feature;

a second impact feature positioned to impact the first impact feature in response to disengagement of the first and second engagement features and a tensile force applied to one of the first and second downhole apparatus by the conveyance means; and a release member positionable between first and second positions in response to a signal carried by the conveyance means, wherein the release member prevents disengagement of the first and second engaging features when in the first position but not the second position;

wherein the selectable engagement of the first and second engagement features comprises engagement of an outer surface of the first engagement feature and an inner surface of the second engagement feature, and wherein an outer surface of the release member contacts an inner surface of the first engagement feature when the release member is in the first position.

2. The apparatus of claim 1 wherein the first and second interfaces are for threadedly coupling with the first and second downhole apparatus, respectively.

3. The apparatus of claim 1 wherein the outer surface of the release member does not contact the inner surface of the first engagement feature when the release member is in the second position.

4. The apparatus of claim 1 wherein the first engagement feature comprises a plurality of flexible members each having a first profile, the second engagement member comprises a substantially annular member having the second engagement feature inner surface, and the second engagement feature inner surface has a second profile substantially corresponding to the first profile.

5. The apparatus of claim 4 wherein the release member contacts an inner surface of at least one of the plurality of flexible members when in the first position.

6. The apparatus of claim 5 wherein the release member does not contact the inner surface of any of the plurality of flexible members when in the second position.

7. The apparatus of claim 1 wherein the second portion further comprises an actuator operable to reposition the release member between the first and second positions in response to the signal.

8. The apparatus of claim 7 wherein the actuator comprises an electronic solenoid switch.

9. The apparatus of claim 1 wherein the second portion further comprises:

an actuator operable to reposition the release member from the first position to the second position; and a mechanical, electrical, electromechanical, magnetic, or electromagnetic biasing member operable to reposition the release member from the second position to the first position.

10. The apparatus of claim 1 wherein the first and second impact features comprise substantially parallel features carried by the first and second portions, respectively.

11. The apparatus of claim 10 wherein the substantially parallel features are substantially perpendicular to a longitudinal axis of the impact apparatus.

12. The apparatus of claim 1 wherein the impact apparatus further comprises an electrical conductor extending through passages of each of the first and second interfaces, the first and second engagement features, and the release member.

13. The apparatus of claim 1 further comprising the first and second downhole apparatus.

14. An apparatus, comprising:

an impact apparatus conveyable in a tool string via conveyance means within a wellbore extending into a subterranean formation, wherein the impact apparatus comprises:

a first portion, comprising:

a first interface for coupling with a first downhole apparatus;

a first engagement feature; and a first impact feature; and a second portion, comprising:

a second interface for coupling with a second downhole apparatus;

a second engagement feature in selectable engagement with the first engagement feature;

a second impact feature positioned to impact the first impact feature in response to disengagement of the first and second engagement features and a tensile force applied to one of the first and second downhole apparatus by the conveyance means; and a release member positionable between first and second positions in response to a signal carried by the conveyance means, wherein the release member prevents disengagement of the first and second engaging features when in the first position but not the second position;

wherein the first engagement feature comprises a plurality of flexible members each having a first profile, the second engagement member comprises a substantially annular member having an inner surface, the inner surface has a second profile substantially corresponding to the first profile, and the release member contacts an inner surface of at least one of the plurality of flexible members when in the first position.

15. The apparatus of claim 14 wherein the release member does not contact the inner surface of any of the plurality of flexible members when in the second position.

16. An apparatus, comprising:

an impact apparatus conveyable in a tool string via conveyance means within a wellbore extending into a subterranean formation, wherein the impact apparatus comprises:

a first portion, comprising:

a first interface for coupling with a first downhole apparatus;

a first engagement feature; and a first impact feature; and a second portion, comprising:

a second interface for coupling with a second downhole apparatus;

a second engagement feature in selectable engagement with the first engagement feature;

a second impact feature positioned to impact the first impact feature in response to disengagement of the first and second engagement features and a tensile force applied to one of the first and second downhole apparatus by the conveyance means;

a release member positionable between first and second positions in response to a signal carried by the conveyance means, wherein the release member prevents disengagement of the first and second engaging features when in the first position but not the second position; and an actuator operable to reposition the release member between the first and second positions in response to the signal.

17. The apparatus of claim 16 wherein the actuator comprises an electronic solenoid switch.

18. An apparatus, comprising:

an impact apparatus conveyable in a tool string via conveyance means within a wellbore extending into a subterranean formation, wherein the impact apparatus comprises:

a first portion, comprising:

a first interface for coupling with a first downhole apparatus;

a first engagement feature; and a first impact feature; and a second portion, comprising:

a second interface for coupling with a second downhole apparatus;

a second engagement feature in selectable engagement with the first engagement feature;

a second impact feature positioned to impact the first impact feature in response to disengagement of the first and second engagement features and a tensile force applied to one of the first and second downhole apparatus by the conveyance means;

a release member positionable between first and second positions in response to a signal carried by the conveyance means, wherein the release member prevents disengagement of the first and second engaging features when in the first position but not the second position;

an actuator operable to reposition the release member from the first position to the second position; and a mechanical, electrical, electromechanical, magnetic, or electromagnetic biasing member operable to reposition the release member from the second position to the first position.

* * * * *